US008789538B2

(12) United States Patent
Koguchi

(10) Patent No.: US 8,789,538 B2
(45) Date of Patent: Jul. 29, 2014

(54) COSMETIC MATERIAL APPLYING DEVICE

(75) Inventor: Tomonori Koguchi, Kawaguchi (JP)

(73) Assignee: Tokiwa Corporation, Nakatsugawa-Shi, Gifu (JP)

( * ) Notice: Subject to any disclaimer, the term of this patent is extended or adjusted under 35 U.S.C. 154(b) by 0 days.

(21) Appl. No.: 13/449,566

(22) Filed: Apr. 18, 2012

(65) Prior Publication Data

US 2012/0266908 A1 Oct. 25, 2012

(30) Foreign Application Priority Data

Apr. 20, 2011 (JP) ..... 2011-093621
Nov. 21, 2011 (JP) ..... 2011-254316

(51) Int. Cl.
*A45D 19/02* (2006.01)
*A45D 34/04* (2006.01)

(52) U.S. Cl.
CPC ..... *A45D 19/02* (2013.01); *A45D 34/045* (2013.01)
USPC ..... 132/218

(58) Field of Classification Search
CPC ..... A46B 2200/1053; A46B 2200/106; A46B 9/021
USPC ..... 132/218, 313, 320, 108–111, 120; 401/129; 15/104.94, 114, 110, 15/187–188, 205.2
See application file for complete search history.

(56) References Cited

U.S. PATENT DOCUMENTS

| | | | | |
|---|---|---|---|---|
| 1,661,713 | A * | 3/1928 | Barker | 15/188 |
| 1,673,638 | A * | 6/1928 | Peterson | 15/176.5 |
| 2,217,439 | A * | 10/1940 | Fuller | 15/188 |
| 4,165,755 | A * | 8/1979 | Cassai | 132/218 |
| 5,007,442 | A * | 4/1991 | Hirzel | 132/218 |
| 5,325,878 | A * | 7/1994 | McKay | 132/116 |
| 6,050,273 | A * | 4/2000 | Lhuisset | 132/317 |
| 7,886,397 | B2 * | 2/2011 | Gueret | 15/160 |
| 2008/0006287 | A1 * | 1/2008 | Gueret | 132/218 |
| 2010/0192968 | A1 * | 8/2010 | Gueret | 132/200 |
| 2011/0155162 | A1 * | 6/2011 | Arditty et al. | 132/200 |
| 2011/0164914 | A1 * | 7/2011 | Caulier | 401/129 |
| 2011/0174328 | A1 * | 7/2011 | Cerutti et al. | 132/200 |

* cited by examiner

*Primary Examiner* — Rachel Steitz
*Assistant Examiner* — Jennifer Gill
(74) *Attorney, Agent, or Firm* — Bacon & Thomas, PLLC

(57) ABSTRACT

A cosmetic material applying device which can efficiently apply a cosmetic material by fixing an applying member to prevent detachment, and improve exposure of the surface coming into contact with the hair, thus minimizing entwining the hair while combing the hair. In an embodiment the cosmetic material applying device has an applying member constructed of an elastic material, and a main body portion with an applying portion to which the applying member can be installed. In this embodiment the main body portion is further provided with a plurality of locking members which lock the applying member to the applying portion, comb teeth in a longer direction of the applying portion, comb teeth in a shorter direction in a leading end of the applying portion, and a through hole.

15 Claims, 10 Drawing Sheets

COSMETIC MATERIAL APPLYING DEVICE

BACKGROUND OF THE INVENTION

1. Field of the Invention

The present invention relates to a cosmetic material applying device which is used for applying a liquid cosmetic material.

2. Description of the Conventional Art

In a cosmetic material used for hair, there are variously a hair manicure, a hair dye, a hair dressing material and the like, and it is common to use an applying device such as a comb having a lot of teeth or a brush at a time of applying the cosmetic materials for hair.

However, at a time of actually applying the cosmetic material to the hair, it is often the case that the cosmetic material is used after being attached to the hair by a user's own hand before using the comb or the brush, and the user has to wash away the cosmetic material left in the hand.

Further, in the case that the cosmetic material is used by being attached to the applying device, it is often the case that a sufficient amount of cosmetic material is not attached to the teeth of comb, so that it takes a lot of trouble with attachment of the cosmetic material to the applying device again and again and an efficiency is not good.

In order to solve the problem as mentioned above, there have been proposed various applying devices which are provided with members for retaining the cosmetic materials.

For example, in Japanese Unexamined Utility Model Publication No. 1-164904, there is described a cosmetic material applying device for hair in which a plurality of teeth of comb 6 are arranged in an applying portion 5 in a line, and a cosmetic material retaining member 7 is provided so as to be inserted into a through hole 6*a* which is provided in an inner portion of the teeth of comb 6, whereby a cosmetic material impregnated in the cosmetic material retaining member 7 can be applied to the hair.

Further, in Japanese Unexamined Utility Model Publication No. 4-123120, there is described a hair brush which is provided with a member 1 retaining a liquid material, and a member 2 for bringing the liquid material into contact with the hair.

However, in the cosmetic material applying device for the hair described in Japanese Unexamined Utility Model Publication No. 1-164904 mentioned above, since the cosmetic material retaining member 7 is provided within the through hole 6*a* in the inner portion of the comb teeth 6, an exposure area of the cosmetic material retaining member 7 is reduced by the comb teeth 6, and it has been hard to efficiently apply a large amount of cosmetic material at a time of applying the cosmetic material to the hair.

Further, the hair brush described in Japanese Unexamined Utility Model Publication No. 4-123120 mentioned above is structured such that the liquid material retaining member 1 corresponding to the member for retaining the liquid material is attached to the hair brush by being pressed into a concave portion 3 or the like, and is not structured such as to be attached by using a special member, and there is a risk that the liquid material retaining member 1 is detached from the hair brush in an alternating succession of the application.

Further, in the case that the cosmetic material for hair having a high viscosity is applied, it is often the case that the hair entwines with the comb teeth by carrying out a motion of combing the hair while attaching the cosmetic material to the hair, whereby the hair is pulled out of a scalp, and an improvement has been demanded.

SUMMARY OF THE INVENTION

Accordingly, an object of the present invention is to provide a cosmetic material applying device which can efficiently apply a cosmetic material to the hair or the like by locking an applying member impregnated with the cosmetic material so as to prevent detachment and improve exposure of the surface coming into contact with the hair, thus minimizing entwining the hair while combing the hair and applying the cosmetic material.

In accordance with the present invention, there is provided a cosmetic material applying device comprising:

an applying member formed by an elastic material capable of being impregnated with a liquid cosmetic material; and a main body portion which is provided with a rod-shaped shaft portion, a grip portion arranged on one end of the shaft portion, and an applying portion capable of locking the applying member arranged on another end of the shaft portion, wherein the applying portion of the main body portion further comprises:

teeth of comb in a longer direction which are constructed by a plurality of teeth provided in a row in the longer direction erectly;

teeth of comb in a shorter direction which are constructed by a plurality of teeth provided in a row in the shorted direction of a leading end of the applying portion erectly;

a plurality of through holes; and a plurality of locking members for locking the applying member to the applying portion, having projections formed at their vertex portions, wherein the projections of the locking members are provided in such a manner as to be positioned in an end of a top surface of the applying member at a time of locking the applying member to the applying portion.

Further, the comb teeth in the longer direction are provided in such a manner as to be positioned in both sides in the longer direction of the applying member which is locked to the applying portion.

Further, the comb teeth in the longer direction are provided in the applying portion in a plurality of rows along the shorter direction.

Further, the top surface of the applying member is at a position which is lower than the vertex position of each tooth in the comb teeth in the longer direction and the comb teeth in the shorter direction, at a time of being locked to the applying portion.

Further, the locking members are provided in such a manner that the projections are positioned at the end of the top surface in the longer direction of the applying member.

Further, the locking members are provided in such a manner that the projections are positioned at the end of the top surface in the shorter direction of the applying member.

Further, the locking members are provided in such a manner that the projections are positioned at the ends of the top surfaces in the longer direction and the shorter direction of the applying member.

Further, the shaft portion is inflected in the middle of the axial direction.

Further, the shaft portion is structured such that at least one corner portion is formed in such a manner as to extend in an axial direction of an outer peripheral surface.

With the structure mentioned above, it is possible to lock the applying member in such a manner as to prevent the applying member from being detached, and it is possible to make the applying surface of the applying member be exposed much.

In accordance with the present invention, there is provided a cosmetic material applying device in which the applying member can be prevented from being detached from the applying portion by enabling the applying member to be locked to the applying portion by the projections of the locking members, and an area at which the applying member comes into direct contact with the hair can be increased at a time of applying the liquid cosmetic material to the hair or the like, thereby efficiently apply the liquid cosmetic material.

Further, since the applying member is formed by the elastic body, and the comb teeth in the longer direction and the comb teeth in the shorter direction are provided erectly in a row, it is possible to decrease the possibility that hair will be entwined with the comb teeth at a time of combing the hair while applying the liquid cosmetic material to the hair.

BRIEF EXPLANATION OF THE DRAWINGS

FIGS. 4A, 4B and 4C show the main body portion in accordance with the first embodiment, in which FIG. 4A is a bottom view, FIG. 4B is a side view, and FIG. 4C is a plan view;

FIGS. 5A and 5B are enlarged perspective views showing an applying portion of the main body portion in accordance with the first embodiment, in which FIG. 5A shows a state in which an applying member is not locked, and FIG. 5B shows a state in which the applying member is locked;

FIGS. 7A and 7B show a main body portion in accordance with a second embodiment, in which FIG. 7A is a side view and FIG. 7B is a plan view;

DETAILED DESCRIPTION OF PREFERRED EMBODIMENTS

Figure 1:
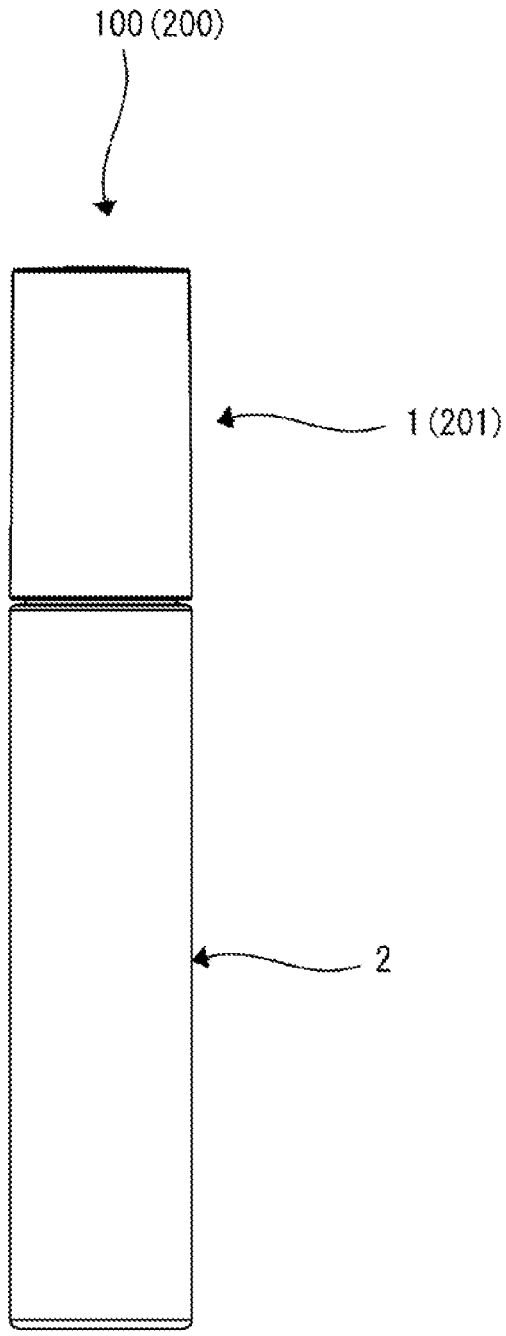
FIG. 1 shows an outside view of the bottle in the case that a main body portion of a cosmetic material applying device in accordance with the present invention is accommodated in a bottle.

A description will be given below in detail of embodiments in accordance with the present invention with reference to the accompanying drawings. In this case, the same reference numerals are attached to the same or corresponding elements and an overlapping description will be omitted.

In the present embodiment, the description will be given of a cosmetic material applying device for applying a liquid cosmetic material such as a hair dye material, a pigment for hair and a hair dressing material to the hair. Further, the liquid cosmetic material in the present invention is assumed to include a cosmetic material having any viscosity except a solid cosmetic material, including a semisolid cosmetic material.

First of all, a description will be given of a cosmetic material applying device 100 in accordance with a first embodiment.

Figure 2:
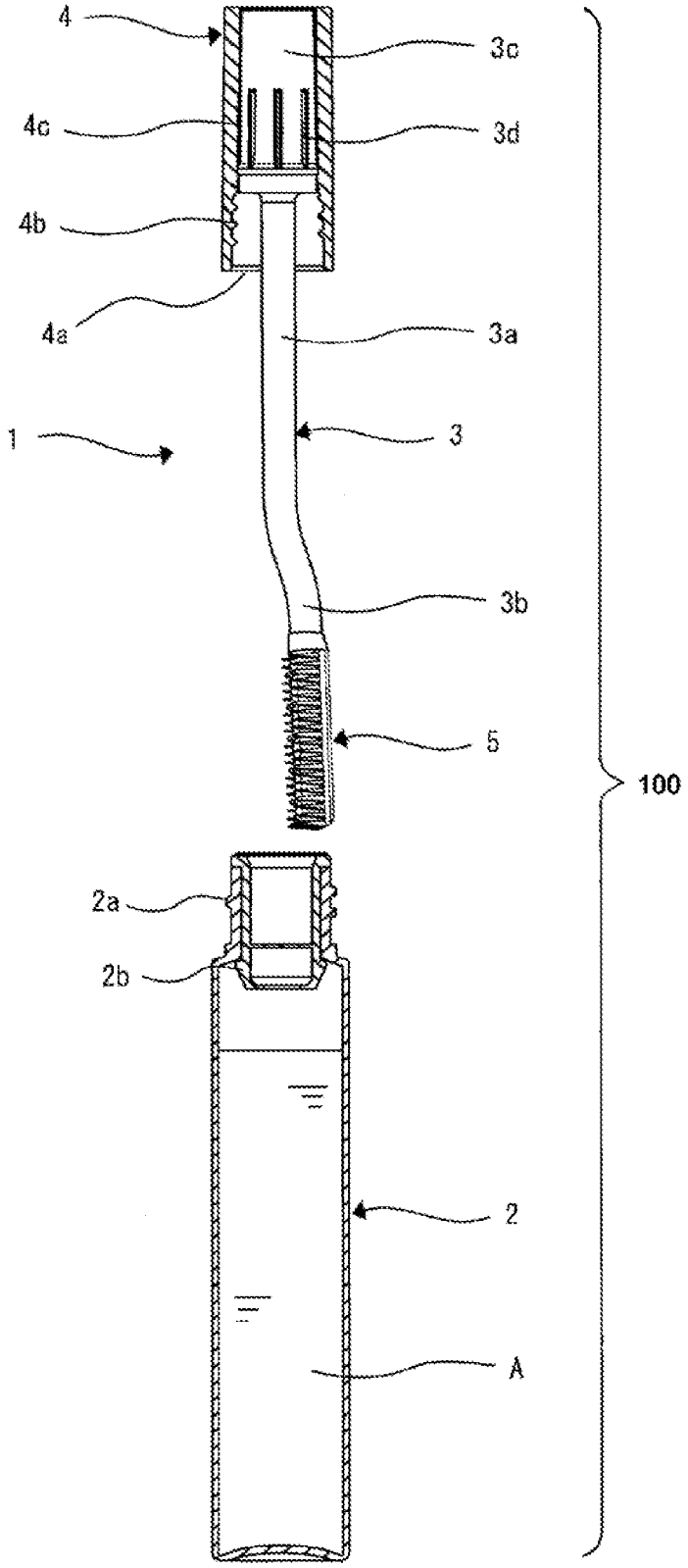
FIG. 2 is a view in the case of viewing a part of a main body portion of a cosmetic material applying device in accordance with a first embodiment and a cross sectional view of the bottle from a front face.

The cosmetic material applying device 100 in accordance with the first embodiment can be used by being combined with a bottle 2 which can accommodate a liquid cosmetic material A in an inner portion, as shown in FIG. 1 and FIG. 2. In this case, a structure which can be combined with the cosmetic material applying device 100 in accordance with the present invention is not limited to a bottom type as long as a container can accommodate a liquid cosmetic material such as a jar container or the like, in addition to the illustrated bottle 2.

FIG. 2 to FIG. 5 show a partly cross sectional view, a general perspective view, a three-elevational view and an enlarged view of a main body portion 1 of the cosmetic material applying device 100 in accordance with the first embodiment. Further, as shown in these drawings, the main body portion 1 is constructed by a rod-shaped shaft portion 3, a grip portion 4 which is provided at one end of the shaft portion 3 and plays a part in a portion which a user grips at a time of using the main body portion 1, and an applying portion 5 which is provided at another end of the shaft portion 3 so as to come into direct contact with the hair and apply the liquid cosmetic material, and can lock an applying member 6 playing a part in combing the hair.

The shaft portion 3 is formed as a rod shape having a round cross section, is inflected slightly in the middle in an axial direction, and is divided into a base portion side 3*a* and a leading end side 3*b* while holding the inflected portion therebetween. Further, the shaft portion 3 is formed as a shape (a crank shape) which is shifted in parallel in such a manner that axes of the base portion side 3*a* and the leading end side 3*b* are in parallel. Since the shaft portion 3 is formed as the crank shape as mentioned above, it is easy to bring the applying portion 5 into contact with the hair in the case that a user combs the hair.

Further, as shown in FIG. 2, one end of the shaft portion 3 (an end of the base portion side 3*a*) is provided with a plug body 3*c* which is formed so as to be somewhat tapered toward the above of the drawing, and a plurality of protrusions 3*d* which can engage with protrusions 4*c* mentioned below of the grip portion 4 are formed in an axial direction on an outer peripheral surface of the plug body 3*c*.

Figure 5A:
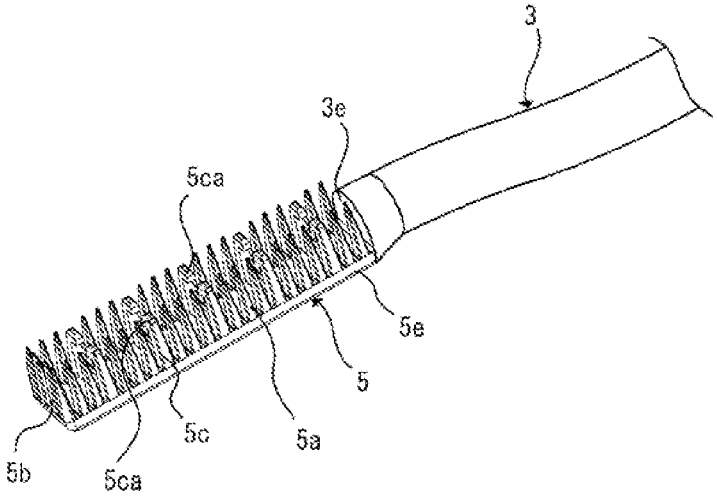
Figure 5B:
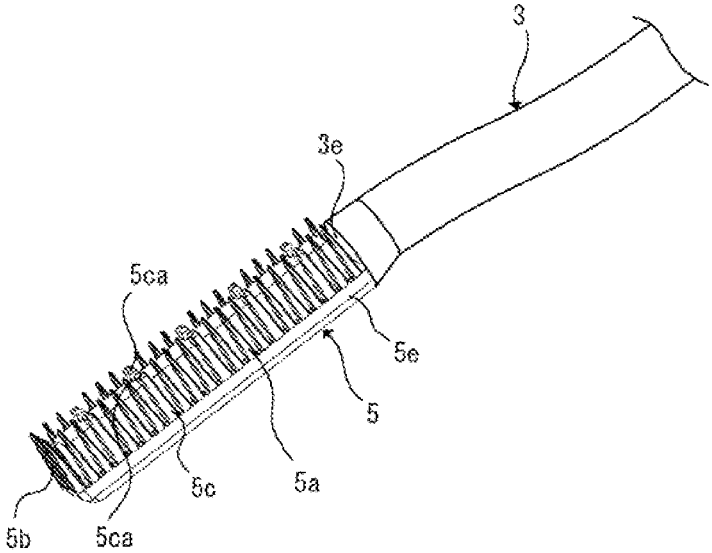

Further, as shown in FIG. 5, the leading end side 3*b* is provided with a wall 3*e* for restricting a motion in an axial direction of the applying member 6 at a time when the applying member 6 is locked to the applying portion 5.

The grip portion 4 is formed in a cylindrical outer shape having an opening portion 4*a* at one end, a female thread 4*b* which can be connected by screw to a male screw 2*a* of the bottle 2 shown in FIG. 2 is formed in an inner peripheral surface in the vicinity of the opening portion 4*a*, and a protrusions 4*c* which can engaged with the protrusions 3*d* formed in the plug body 3*c* of the shaft portion 3 mentioned above is formed in an inner peripheral surface.

Further, the grip portion 4 and the shaft portion 3 are engaged so as to be non-rotatable in a peripheral direction and are engaged so as to be movable in an axial direction on the basis of the engagement between the protrusion 3*d* and the protrusion 4*c*, by fitting the grip portion 4 having the structure mentioned above to the plug body 3*c* of the shaft portion 3 (one end of the shaft portion 3) from the opening portion 4*a* side. In other words, the grip portion 4 and the shaft portion 3 become integrated.

The main body portion 1 is structured as mentioned above such that the grip portion 4 and the shaft portion 3 are integrated, and the female thread 4*b* of the grip portion 4 can connect by screw to the male screw 2*a* of the bottle 2, therefore the main body portion 1 and the bottle 2 can be detachably engaged.

The applying portion 5 is provided at another end (an end of the leading end side 3*b*) which is an opposite side to the side in which the grip portion 4 of the shaft portion 3 is provided, and is used by locking the applying member 6.

As a structure of the applying portion 5, it has as main constructing elements a pedestal portion 5*e* which extends horizontally in an axial direction from an end of the leading end side 3*b* of the shaft portion 3, longer direction comb teeth 5*a* and shorter direction comb teeth 5*b* for combing the hair which are provided so as to stand erect in a vertical direction from the pedestal portion 5*e*, and a locking member 5*c* for locking the applying member 6 which is locked to the applying portion 5.

Figure 4A:
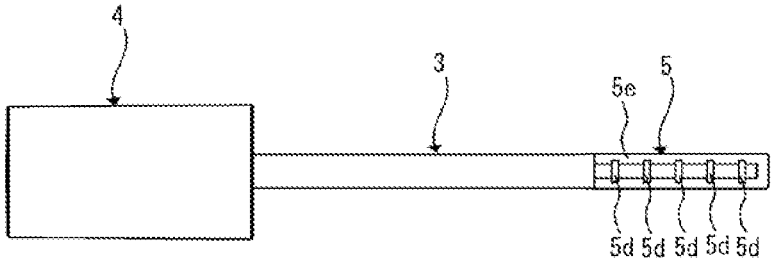
Figure 4B:
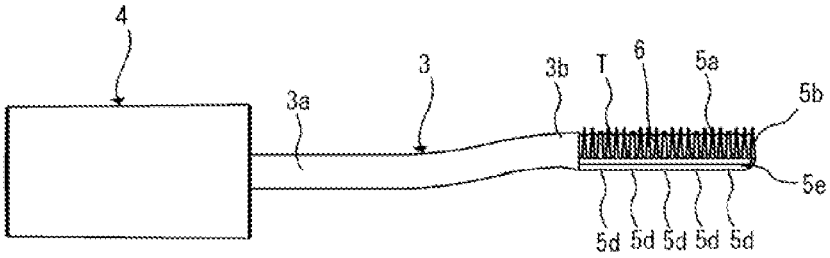

The pedestal portion 5*e* extends horizontally in the axial direction from the leading end side 3*b* of the shaft portion 3, as shown in FIG. 4B, and the leading end side 3*b* of the shaft portion 3 and the pedestal portion 5*e* are formed as an identical shaft shape. In other words, the pedestal portion 5*e* becomes in parallel to axis of the base portion side 3*a* of the shaft portion 3 in the same manner as the leading end side 3*b* of the shaft portion 3. Further, the pedestal portion 5*e* is provided with a plurality of through holes 5*d* shown in FIGS. 4A and 4B. The through hole 5*d* is formed as a hole which can pass a liquid cosmetic material through.

In this case, as shown in FIG. 4A, the shape of the through hole 5*d* is formed as a rectangular shape in the present embodiment, however, it may be formed as a circular shape, an oval shape or the like, and the shape thereof is not particularly limited as long as it plays a part in passing the liquid cosmetic material through.

Figure 3:
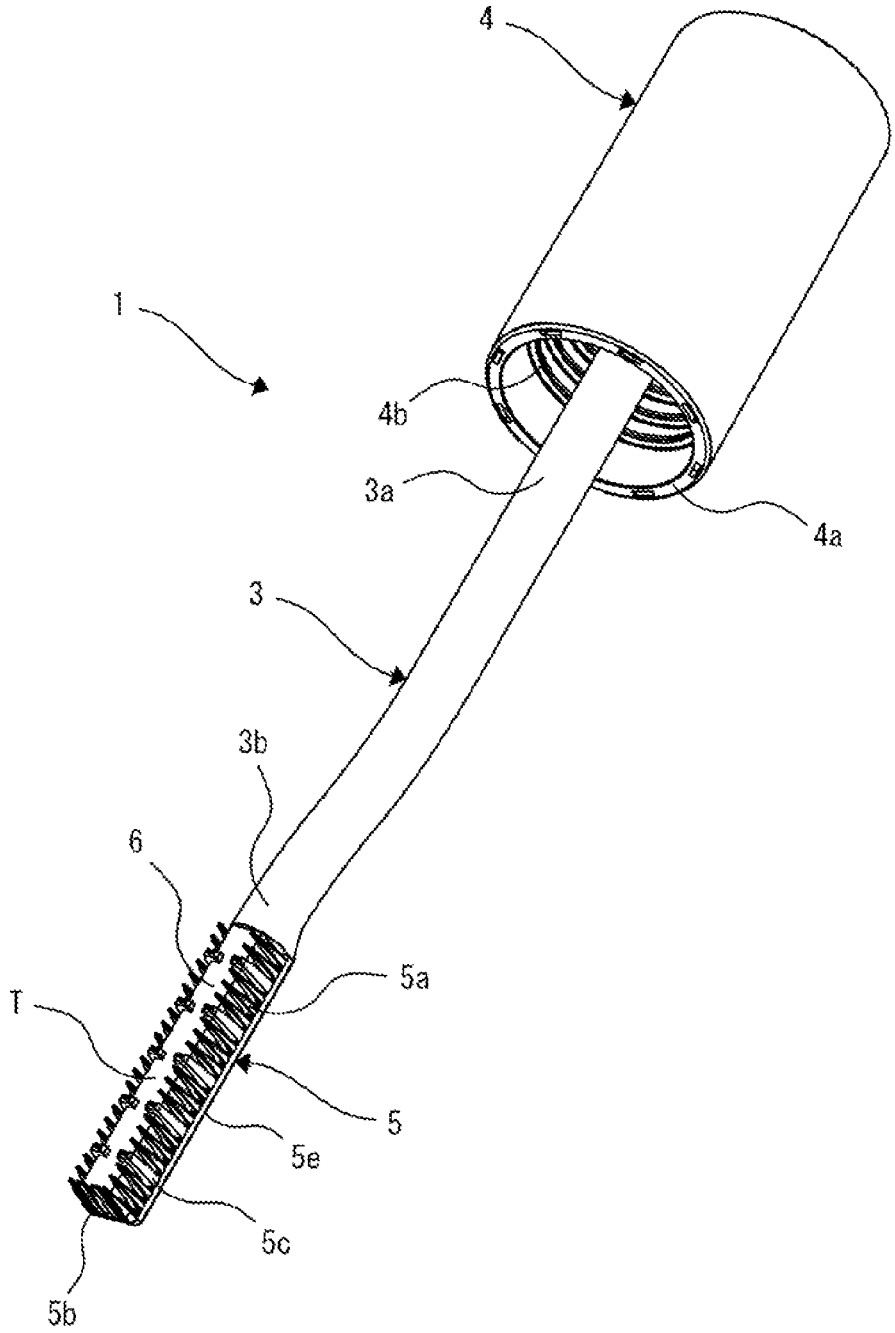
FIG. 3 is a perspective view of the main body portion in accordance with the first embodiment.
Figure 4C:
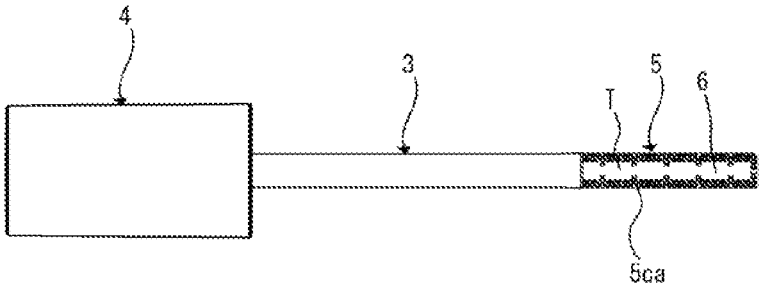

The longer direction comb teeth 5*a* are formed, as shown in FIG. 3 to FIG. 5, such that a plurality of teeth extending so as to stand erect in a vertical direction from the pedestal portion 5*a* come in a row in both ends of the longer direction of the pedestal portion 5*e* (come in a row in both sides of the longer direction of the applying member 6 which is locked to the applying portion 5). Further, a leading end of each tooth of the longer direction comb teeth 5*a* is formed as a tapered shape in the present embodiment so as to come to such a shape as to easily comb the hair.

The shorter direction comb teeth 5*b* are formed, as shown in FIG. 3 to FIG. 5, such that a plurality of teeth extending so as to stand erect in a vertical direction from the pedestal portion 5*e* come in a row in the shorter direction of the leading end portion of the pedestal portion 5. Further, in this shorter direction comb teeth 5*b*, each tooth is formed as a tapered shape in the present embodiment in the same manner as the longer direction comb teeth 5*b*, and come to such a shape as to easily comb the hair.

A plurality of locking members 5*c* are provided between the respective teeth of the longer direction comb teeth 5*a* in such a manner as to stand erect in the vertical direction from the pedestal portion 5*e*, as shown in FIG. 3 to FIG. 5, and a projections 5*ca* protruding in an inward direction of the pedestal portion 5*e* is formed in a leading end thereof. An upward movement of the applying member 6 mentioned below is restricted by the projection 5*ca*.

Further, a height position in the vertical direction of the locking member 5*c* is formed in such a manner as to be lower than a height position in the vertical direction of the longer direction comb teeth 5*a* and the shorter direction comb teeth 5*b*.

Then, the applying member 6 is locked to the applying portion 5 having the structure mentioned above.

The applying member 6 is formed as a rectangular shape as shown in FIG. 3 to FIG. 5, and an open cell foamed material such as an expanded polyurethane or the like and a fiber bundle are suitable for the raw material thereof, however, the raw material is not particularly limited as long as it can be impregnated with a fixed amount of liquid cosmetic material A so as to retain and has an elasticity which tends to compress and restore.

Further, the applying member 6 is locked to the applying portion 5 in such a manner that the longer direction comb teeth 5*a*, the shorter direction comb teeth 5*b* and the locking member 5*c* surround its periphery as illustrated, and it closes the through holes 5*d* of the pedestal 5*e*. At this time, the projection 5*ca* of the locking member 5*c* is positioned at an end of a top surface T of the applying member 6 as shown in FIG. 3 and FIG. 4, and is locked to the applying portion 5. Further, since the applying member 6 is pressed its top surface T by the projection 5*ca*, the top surface T of the applying member 6 locked to the applying portion 5 is locked in such a manner as to come to a lower position than a vertex position of the longer direction comb teeth 5*a* and the shorter direction comb teeth 5*b*.

Since the cosmetic material applying device 100 in accordance with the first embodiment described above can lock the applying member 6 in such a manner as to prevent from being detached from the applying member 5 at least by the projections 5*ca* of the locking member 5*c*, and can increase an area in which the top surface T of the applying member 6 can come into direction contact with the hair without any other shielding material than the projections 5*ca* as shown in FIG. 3 and FIG. 4, by employing the structure as mentioned above, it is possible to efficiently apply the liquid cosmetic material A.

Further, the applying member 6 is locked to the applying portion 5 by the locking member 5*c*, however, it is structured so as to prevent detachment from the applying portion 5 in a normal use, by being controlled in its movement in the axial direction by the shorter direction comb teeth 5*b* and the wall 3*e* of the shaft portion 3 shown in FIG. 5.

Further, on the basis of the structure mentioned above, it is possible to manufacture the portion except the grip portion 4 of the main body portion 1 in one part, thereby to hold down the parts number, and to reduce a manufacturing cost.

In this case, a description will be given of an aspect at a time of actually using the cosmetic material applying device 100 in accordance with the first embodiment.

First of all, the cosmetic material applying device 100 is connected by screw to the bottle 2 and the applying portion 5 is inserted to the inner portion of the bottle 2. At this time, since the through holes 5*d* are provided in the applying portion 5 as shown in FIGS. 4A and 4B, the liquid cosmetic material A can be absorbed not only from the top surface T of the applying member 6 but also from the bottom surface of the applying portion 5 provided with the through holes 5*d*. Accordingly, it is possible to efficiently impregnate the entire applying member with the liquid cosmetic material A.

Further, since the cosmetic material applying device 100 is provided with a scraping portion 2*b* in the bottle 2 as shown in FIG. 2, a surplus liquid cosmetic material A attached to the longer direction comb teeth 5*a* and the shorter direction comb teeth 5*b* is scraped by the scraping portion 2*b* at a time of taking the cosmetic material applying device 100 out of the bottle 2. At this time, in the cosmetic material applying device 100, since the respective teeth of the longer direction comb teeth 5*a* and the shorter direction comb teeth 5*b* become identical at their vertex positions as shown in FIG. 4B (come to a state in which the vertex positions are flat in a side elevational view), and the top surface T of the applying member 6 is at a lower position than the vertex of each tooth of the comb teeth, the scraping portion 2*b* and the applying member 6 less come into contact with each other, so that it is possible to uniformly scrape the surplus liquid cosmetic material A attached to each tooth of the comb teeth, and the liquid cosmetic material A impregnated in the applying member 6 is not scraped.

Next, the cosmetic material applying device 100 can apply the liquid cosmetic material A impregnated in the applying member 6 to the hair and can simultaneously comb the hair by the longer direction comb teeth 5*a* and the shorter direction comb teeth 5*b*, by carrying out a combing motion in such a manner as to press the applying portion 5 to the hair of the user or the like, after being taken out of the bottom 2.

In the case of combing the hair by using the main body portion 1, it indicates an operation of moving the main body portion 1 in a transverse direction corresponding to a direction which is orthogonal to a transverse in the axial direction of the applying portion 5, without being particularly defined.

Further, in the main body portion 1, the liquid cosmetic material A is applied to the hair by moving the main body portion 1 while pressing the top surface T of the applying member 6 to the hair, however, since the vertex positions are made identical in the longer direction comb teeth 5*a* and the shorter direction comb teeth 5*b* which are provided in the applying portion 5 at this time, the applying member 6 is flattened uniformly in the vertical direction so as to enable the impregnated liquid cosmetic material A to be uniformly applied to the hair.

Figure 6A:
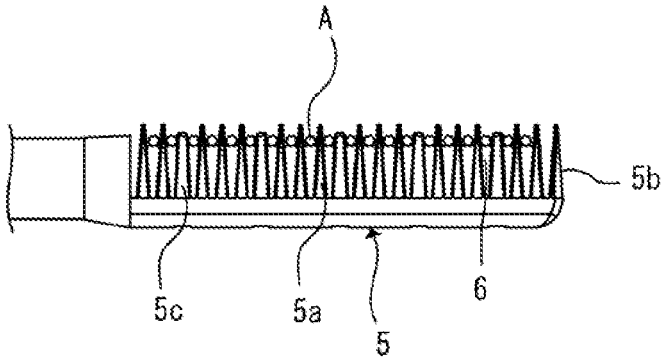
FIG. 6 is a view for explaining a displacement of the applying member at a time of using the cosmetic material applying device in accordance with the present invention.
Figure 6B:
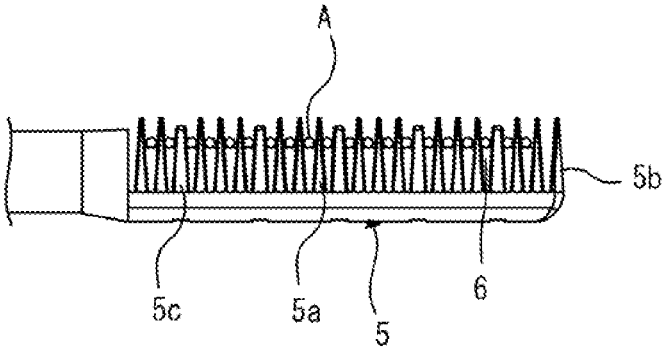
Figure 6C:
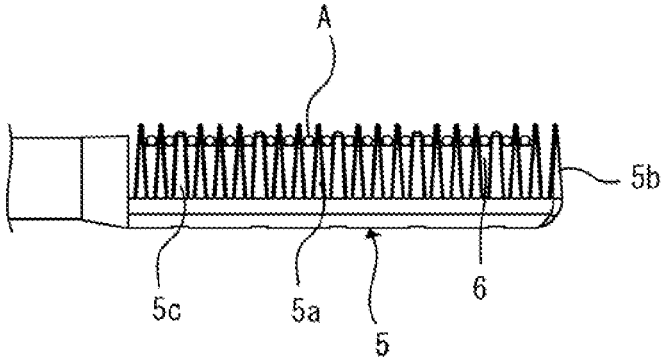

Further, since the applying member 6 has an elasticity, a shape of the applying member 6 is restored as shown in FIG. 6C by taking off the applying portion 5 from the hair. At this time, since the hair entering between the comb teeth is pushed out in a direction of the vertex of each tooth of the comb teeth on the basis of a restoring force of the applying member 6, it is possible to prevent the hair from entwining with the comb teeth.

Further, in the cosmetic material applying device 100, in the case that it is intended to comb a narrow range such as a border of the hair or the like, it is possible to easily carry out a fine work such as combing the narrow portion by using the shorter direction comb teeth 5*b* in such a manner as to move the applying portion 5 in the axial direction.

Next, a description will be given of a cosmetic material applying device 200 in accordance with a second embodiment.

The cosmetic material applying device 200 in accordance with the second embodiment can be used by being combined with the bottle 2 shown in FIG. 1 in the same manner as the cosmetic material applying device 100 in accordance with the first embodiment.

In this case, in the cosmetic material applying device 200 in accordance with the second embodiment, a use of a container having an elongated shape such as an illustrated bottle 2 is supposed.

A difference of the cosmetic material applying device 200 in accordance with the second embodiment from the cosmetic material applying device 100 in accordance with the first embodiment exists in a point that a corner portion 203 is provided on an outer peripheral surface of the shaft portion 3 of a main body portion 201, in the cosmetic material applying device 200 as shown in FIG. 7 to FIG. 10. The other structures have the same structures as the cosmetic material applying device 100 in accordance with the first embodiment.

Figure 7A:
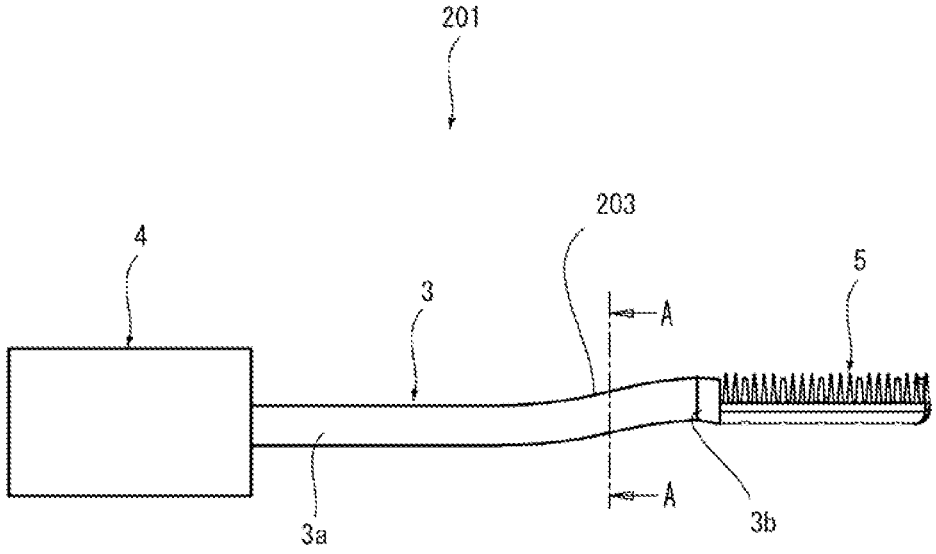
Figure 7B:
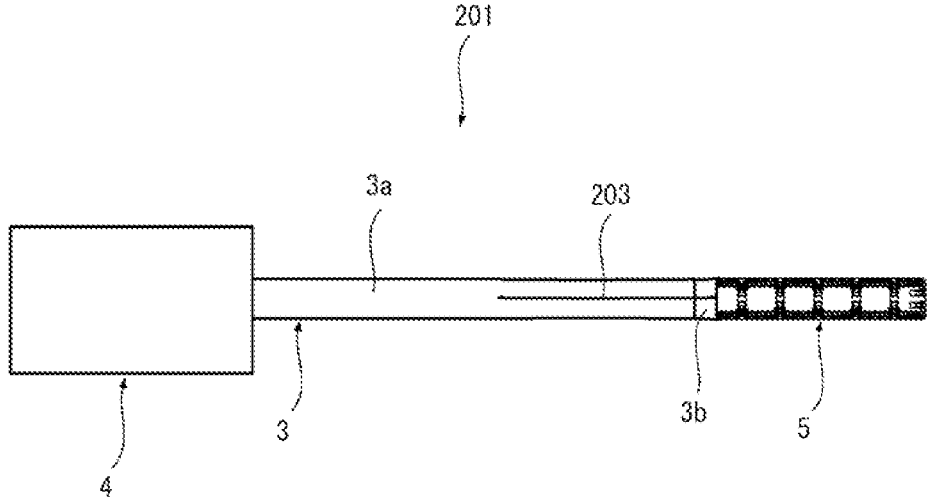
Figure 8:
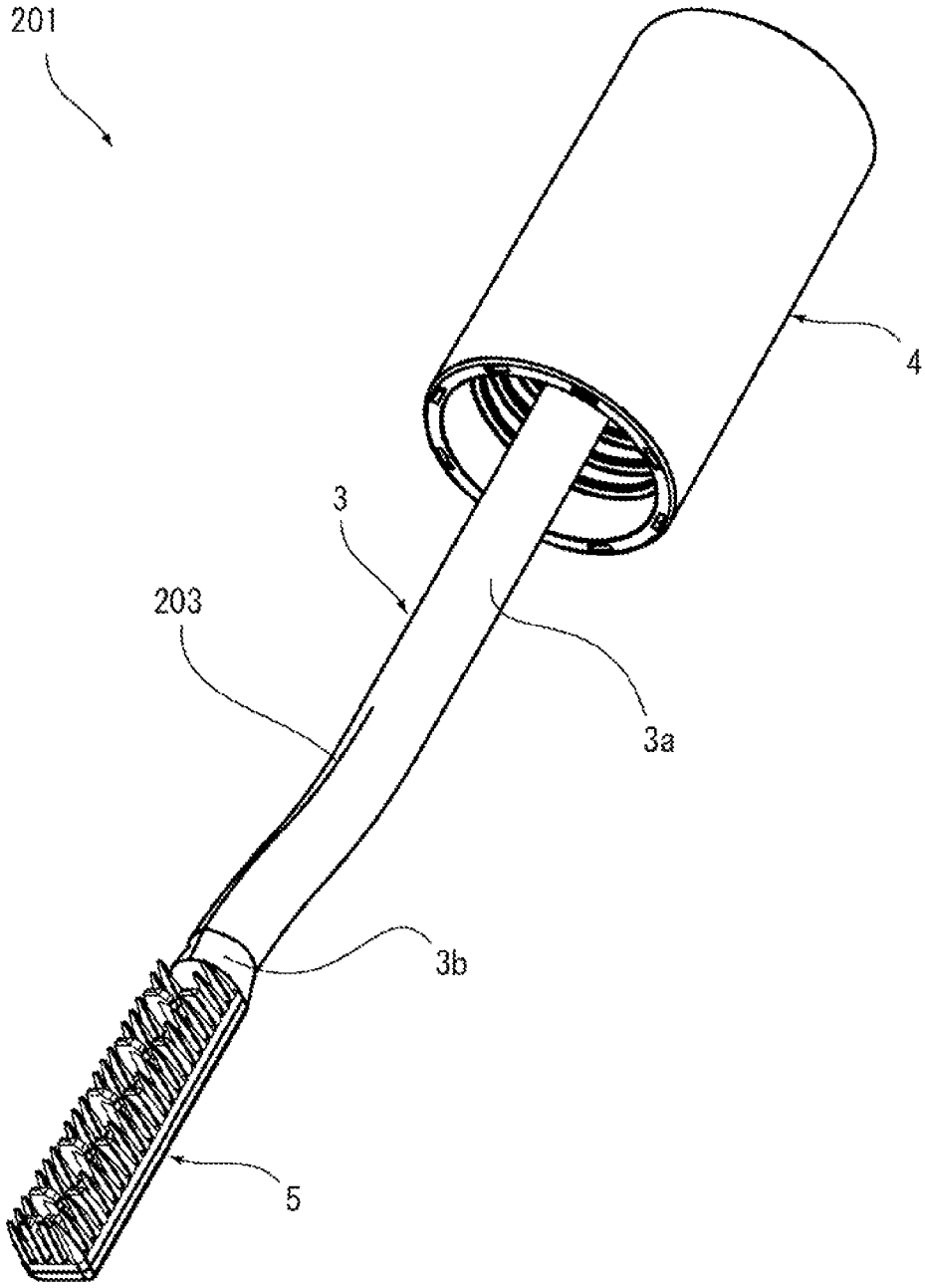
FIG. 8 is a perspective view of the main body portion in accordance with the second embodiment.

In this case, in FIG. 7 and FIG. 8, there is shown the cosmetic material applying device 200 in which the applying member 6 is not locked to the applying portion 5, however, the applying member 6 is locked so as to be used at a time of using the cosmetic material applying device 200.

Figure 10:
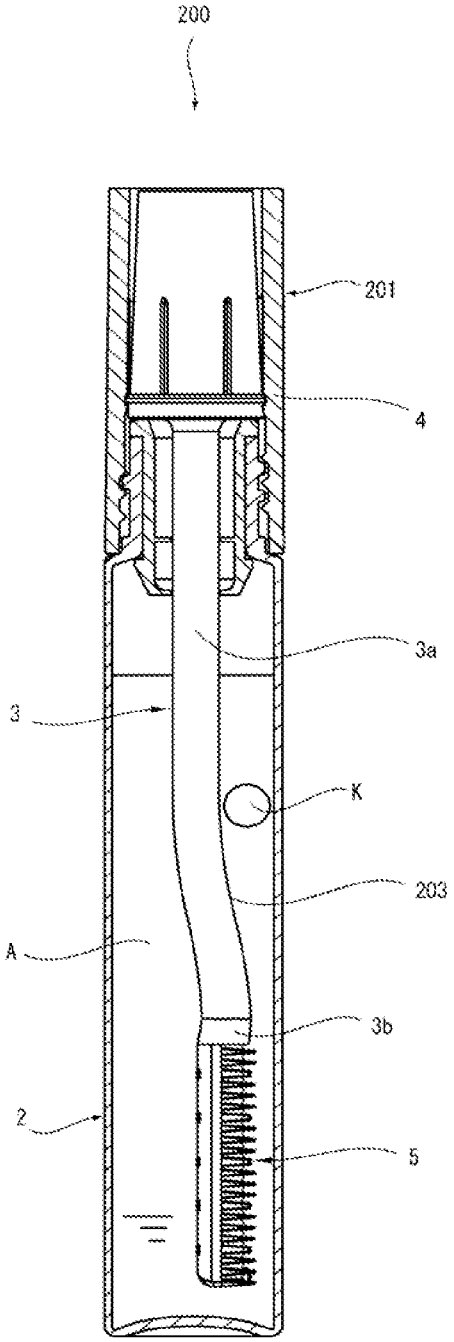
FIG. 10 is a view at a time of viewing a cross sectional view in the case that the main body portion in accordance with the second embodiment is installed to the bottle from a front face.

The corner portion 203 is formed in such a manner as to extend in an axial direction of an outer peripheral surface of the shaft portion 3 from an inflected portion of the shaft portion 3 toward the leading end side 3*b*, as illustrated. At this time, the corner portion 203 is formed in an axial direction of an outer peripheral surface in an upper side on the drawing of the shaft portion 3 expressed in FIG. 7A. This means that it is formed in such a manner as to extend in the axial direction from the outer peripheral surface of the leading end side 3*b* of the shaft portion 3 coming closest to the inner peripheral wall of the bottle 2 by being inflected to the base portion side 3*a*, at a time of inserting the shaft portion 3 of the main body portion 201 to the bottle 2, as shown in FIG. 10.

Figure 9:
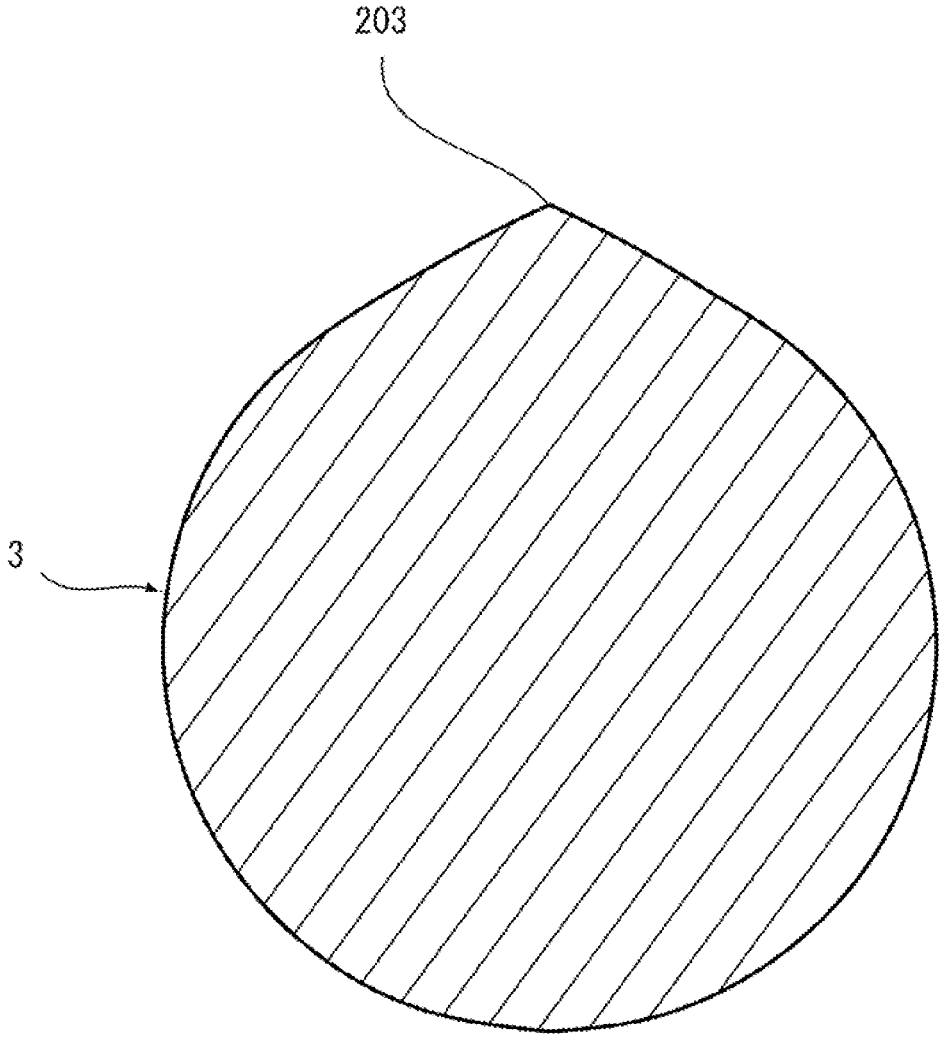
FIG. 9 is a cross sectional view of a shaft portion taken along a line A-A in FIG. 7.

FIG. 9 is a cross sectional view of the shaft portion 3 taken along a line A-A in FIG. 7A. As show in this FIG. 9, the corner portion 203 is one corner which is obtuse in a cross sectional view, and is formed in an eye drop shape as seen by a cross section of the portion in which the corner portion 203 of the shaft portion 3 is formed.

The main body portion 201 having the shaft portion 3 provided with the corner portion 203 having the shape as mentioned above has a small diameter and can accommodate the liquid cosmetic material A in an inner portion thereof, and is supposed to be used in a bottle container which is provided with an agitating ball K for agitating the liquid cosmetic material A. In the bottle container mentioned above (the bottle 2 shown in FIGS. 1 and 10), if the shaft portion 3 in which the cross section having no corner portion 203 is round and which is inflected in such a manner as to come close to the inner peripheral wall of the bottle 2 is inserted into the bottle 2, a distance between the shaft portion 3 and the inner peripheral wall of the bottle 2 becomes narrower little by little from the base end side 3*a* toward the leading end side 3*b* of the shaft portion 3, and there is a case that the agitating ball K is pinched between the shaft portion 3 and the inner peripheral wall of the bottle 2 so as to come to a state in which it can not be pulled out, at a time of pulling out the shaft portion 3 mentioned above from the bottle 2.

However, on the basis of the provision of the corner portion 203 in the shaft portion 3, even if the agitating ball K is going to enter into the gap between the shaft portion 3 and the inner peripheral wall of the bottle 2, the obtuse angle of the corner portion 203 can let the agitating ball K out of the gap between the shaft portion 3 and the inner peripheral wall of the bottle 2.

In the cosmetic material applying device 200 provided with the corner portion 203 mentioned above, since the other structures than the corner portion 203 are the same as the cosmetic material applying device 100 in accordance with the first embodiment, it is possible to obtain the same operations and effects as those of the cosmetic material applying device 100. Further, on the basis of the provision of the corner portion 203, it is possible to prevent the agitating ball K from being pinched in the gap between the shaft portion 3 and the inner peripheral wall of the bottle 2.

Further, in the present second embodiment, the corner portion 203 is formed at a position between the inflected portion of the shaft portion 3 and the leading end side 3*b*, however, this may be formed over a whole length of the shaft portion 3 from the base end side 3*a* toward the leading end side 3*b*, and two or more may be provided.

In this case, the corner portion 203 may have an acute angle in place of the obtuse angle, and a roundness may be formed in the corner of the corner portion 203 as long as the shape does not pinch the agitating ball K in the gap between the shaft portion 3 and the inner peripheral wall of the bottle 2.

The description is given particularly of the present invention on the basis of the embodiments, however, the present invention is not limited to the embodiments mentioned above.

In the present embodiment, as the structure of the applying portion 5, the longer direction comb teeth 5*a* are provided one row by one row in both sides in the longer direction of the applying member 6 which is locked to the applying portion 5, however, the plural rows may be formed in such a manner as to be along the shorter direction. In other words, for example, in the case that the longer direction comb teeth 5*a* are formed two rows by two rows in both sides in the longer direction of the applying member 6, the longer direction comb teeth 5*a* provided in the applying portion 5 come to four rows total.

Further, in the structure of the shorter direction comb teeth 5*b*, in the same manner, the plural rows may be formed in the applying portion 5 in such a manner as to be along the longer direction, in the leading end portion of the pedestal portion 5*e*.

Further, the locking member 5*c* may be provided in the axial direction in addition to being provided between the teeth of the longer direction comb teeth 5*a* of the applying portion 5. in other words, it may be provided between the teeth of the shorter direction comb teeth 5*b* or in the vicinity of the front side of the wall 3*e*.

What is claimed is:

1. A cosmetic material applying device comprising:

an applying member having a rectangular parallelepiped shape, and formed by an elastic material capable of being impregnated with a liquid cosmetic material; and a main body portion which is provided with a rod-shaped shaft portion, a grip portion arranged on a first end of the shaft portion, and an applying portion arranged on a second end of the shaft portion to which said applying member is locked, wherein said applying portion of said main body portion further comprises:

a pedestal portion having a rectangular shape, and extending axially from the second end of the shaft portion;

longitudinally disposed comb teeth defined by a plurality of teeth provided erectly in at least one row along opposite longitudinal sides of the pedestal portion;

transversely disposed comb teeth defined by a plurality of teeth provided erectly in at least one row along at least one transverse side of said pedestal portion;

a plurality of through holes formed in said pedestal portion; and a plurality of locking members provided between the teeth constituting the longitudinally disposed comb teeth in such a manner as to stand erect in the vertical direction from the pedestal portion so that the plurality of locking members extend in the same direction as the longitudinally disposed comb teeth, wherein each locking member has a projection formed at a top end thereof, protruding in an inward direction of the pedestal portion so as to press and lock said applying member to said applying portion, and wherein said projections of said locking members are provided in such a manner as to be positioned at longitudinal edges of a top surface of said applying member when said applying member is locked to said applying portion, and wherein a height position in the vertical direction of the locking members is formed in such a manner as to be lower than a height position in the vertical direction of the longitudinally disposed comb teeth.

2. A cosmetic material applying device as claimed in claim 1, wherein said longitudinally disposed comb teeth are provided in said pedestal portion in a plurality of rows along each longitudinal side thereof.

3. A cosmetic material applying device as claimed in claim 1, wherein the top surface of said applying member is at a position which is lower than a position of the top end of each tooth of said longitudinally disposed comb teeth and said transversely disposed comb teeth, when locked to said applying portion.

4. A cosmetic material applying device as claimed in claim 1, wherein said shaft portion is inflected in the middle in the axial direction.

5. A cosmetic material applying device as claimed in claim 1, wherein said shaft portion is structured such that at least one obtuse corner portion is formed on an outer peripheral surface of the shaft portion in such a manner as to extend along an axial direction thereof.

6. A cosmetic material applying device as claimed in claim 5, wherein the corner portion extends from an inflected portion of the shaft portion toward the second end of the shaft portion.

7. A cosmetic material applying device as claimed in claim 1, wherein said applying member is locked to the applying portion with a state of being surrounded by the longitudinally disposed comb teeth, transversely disposed comb teeth, and the locking members, thereby the top surface of the applying member is exposed outside excepting the edges on which the locking members are positioned.

8. A cosmetic material applying device as claimed in claim 1, wherein the first end of the shaft portion is provided with a tapered plug body having at least one protrusion formed in an axial direction on an outer peripheral surface of the plug body and configured to engage at least one protrusion formed in an inner peripheral surface of the grip portion.

9. A cosmetic material applying device comprising:

an applying member having a rectangular parallelepiped shape, and formed by an elastic material capable of being impregnated with a liquid cosmetic material; and a main body portion which is provided with a rod-shaped shaft portion, a grip portion arranged on one end of the shaft portion, and an applying portion arranged on another end of the shaft portion to which said applying member is locked, wherein said applying portion of said main body portion further comprises:

a pedestal portion having a rectangular shape, and extending axially from the another end of the shaft portion;

longitudinally disposed comb teeth defined by a plurality of teeth provided erectly in at least one row along opposite longitudinal sides of the pedestal portion;

transversely disposed comb teeth defined by a plurality of teeth provided erectly in at least one row along at least one transverse side of said pedestal portion;

a plurality of through holes formed in said pedestal portion; and a plurality of locking members provided between the teeth constituting the longitudinally disposed comb in such a manner as to stand erect in the vertical direction from the pedestal portion so that the plurality of locking members extend in the same direction as the longitudinally disposed comb teeth, wherein each locking member has a projection formed at a top end thereof, protruding in an inward direction of the pedestal portion so as to press and lock said applying member to said applying portion, wherein said projections are provided in such a manner as to be positioned on longitudinal edges of a top surface of said applying member, wherein a height position in the vertical direction of the locking members is formed in such a manner as to be lower than a height position in the vertical direction of the longitudinally disposed comb teeth, and wherein said applying member is locked to the applying portion with a state of being surrounded by the longitudinally disposed comb teeth, transversely disposed comb teeth, and the locking members, thereby the top surface of the applying member is exposed outside excepting the longitudinal edges on which the locking members are positioned, while bottom surface of the applying member closes the through holes.

10. A cosmetic material applying device as claimed in claim 9, wherein said longitudinally disposed comb teeth are provided in said pedestal portion in a plurality of rows along each longitudinal side thereof.

11. A cosmetic material applying device as claimed in claim 9, wherein the top surface of said applying member is at a position which is lower than a position of the top end of each tooth of said longitudinally disposed comb teeth and said transversely disposed comb teeth in the state of being locked to said applying portion.

12. A cosmetic material applying device as claimed in claim 9, wherein said shaft portion is inflected in the middle in the axial direction.

13. A cosmetic material applying device as claimed in claim 9, wherein said shaft portion is structured such that at least one obtuse corner portion is formed on an outer peripheral surface of the shaft portion in such a manner as to extend along an axial direction thereof.

14. A cosmetic material applying device as claimed in claim 13, wherein the corner portion extends from an inflected portion of the shaft portion toward the second end of the shaft portion.

15. A cosmetic material applying device as claimed in claim 9, wherein the first end of the shaft portion is provided with a tapered plug body having at least one protrusion formed in an axial direction on an outer peripheral surface of the plug body and configured to engage at least one protrusion formed in an inner peripheral surface of the grip portion.

* * * * *